US010718143B2

(12) United States Patent
Tuminella et al.

(10) Patent No.: US 10,718,143 B2
(45) Date of Patent: Jul. 21, 2020

(54) SLIDING DOOR SYSTEM

(71) Applicant: Arconic Technologies LLC, Pittsburgh, PA (US)

(72) Inventors: Josh Tuminella, Eastpoint, GA (US); William J. Hooper, Lawrenceville, GA (US); Ion-Horatiu Barbulescu, Atlanta, GA (US); Matthew M. Miller, Atlanta, GA (US)

(73) Assignee: Arconic Technologies LLC, Pittsburgh, PA (US)

( * ) Notice: Subject to any disclaimer, the term of this patent is extended or adjusted under 35 U.S.C. 154(b) by 166 days.

(21) Appl. No.: 15/906,751

(22) Filed: Feb. 27, 2018

(65) Prior Publication Data

US 2019/0264484 A1 Aug. 29, 2019

(51) Int. Cl.

| | |
|---|---|
| ***E05D 15/06*** | (2006.01) |
| ***E05D 15/10*** | (2006.01) |
| ***E06B 3/50*** | (2006.01) |
| ***E05D 15/56*** | (2006.01) |

(Continued)

(52) U.S. Cl.

CPC ..... *E05D 15/1042* (2013.01); *E05D 15/0604* (2013.01); *E05D 15/0665* (2013.01); *E05D 15/56* (2013.01); *E06B 3/50* (2013.01); *E05D 2015/1049* (2013.01); *E05D 2700/00* (2013.01); *E05Y 2201/64* (2013.01); *E05Y 2201/68* (2013.01); *E05Y 2201/688* (2013.01);

(Continued)

(58) Field of Classification Search

CPC ..... E05D 15/1042; E05D 15/1044; E05D 15/0652; E05D 15/0686; E05D 15/0665

USPC ..... 49/221, 222

See application file for complete search history.

(56) References Cited

U.S. PATENT DOCUMENTS 2,740,168 A * 4/1956 Wright ..... E05D 15/1042 49/217

3,293,801 A * 12/1966 Henning ..... E05D 15/10 49/130

(Continued)

FOREIGN PATENT DOCUMENTS

| | | |
|---|---|---|
| CN | 205558672 U | 9/2016 |
| CN | 107165544 A | 9/2017 |

OTHER PUBLICATIONS

ISRWO for PCT/US2019/019569 which claims benefit of U.S. Appl. No. 15/906,751 dated Jun. 13, 2019.

*Primary Examiner* — Marcus Menezes

(74) *Attorney, Agent, or Firm* — Vorys, Sater, Seymour and Pease LLP

(57) ABSTRACT

A sliding door assembly includes a door panel, a frame that supports the door panel and includes a bottom member with a lower profile and a top member with an upper profile, wherein the lower profile and the upper profile are parallel to one another. A lower sliding assembly is operatively coupled to a bottom of the door panel and engages the lower profile, and an upper sliding assembly is operatively coupled to a top of the door panel and engages the upper profile. A gasket interposes the door panel and a portion of the frame when the door panel is in a sealed position. The door panel is movable between the sealed position, where the gasket creates a sealed interface between the door panel and the frame, and a sliding position, where the door panel is moved laterally relative to the frame while remaining substantially perpendicular to a floor.

13 Claims, 10 Drawing Sheets

(51) Int. Cl.
*E06B 7/23* (2006.01)
*E06B 1/52* (2006.01)

(52) U.S. Cl.
CPC ..... *E05Y 2900/132* (2013.01); *E06B 1/52* (2013.01); *E06B 7/23* (2013.01)

(56) References Cited

U.S. PATENT DOCUMENTS

| | | | | | |
|---|---|---|---|---|---|
| 4,486,980 | A * | 12/1984 | O'Bar | E05D 13/04 | 49/213 |
| 6,442,900 | B1 * | 9/2002 | Kvasnes | E05D 15/1042 | 49/409 |
| 7,610,718 | B2 * | 11/2009 | Kopish | E05D 15/1042 | 49/209 |
| 10,047,552 | B2 * | 8/2018 | Lee | E06B 7/2307 | |
| 10,077,594 | B2 * | 9/2018 | Fingerle | E05D 15/10 | |
| 2009/0038228 | A1 * | 2/2009 | Lee | E05D 15/1042 | 49/360 |

* cited by examiner

SLIDING DOOR SYSTEM

FIELD OF THE INVENTION

This application relates to sliding doors and, more specifically, to sliding door assemblies that include sliding assemblies capable of move a sliding door laterally relative to a seal.

BACKGROUND OF THE INVENTION

Sliding doors and other door systems are known in the art for providing means of restricting and permitting access to structures. Sliding doors can be advantageous over swinging doors because they can provide a large opening without requiring as much space for the doors to swing.

While sliding doors are desirable for space reasons, some sliding door systems are difficult to seal. Many sliding door systems include some type of weather stripping or a brush along a lower edge of each door panel to form a seal with the floor surface. However, in order to effectively seal, these types of weather stripping or brushes must slide along the floor while the door system is being opened or closed. Accordingly, the weather stripping can wear rather quickly until it loses effectiveness at forming a seal. If the unit is adjusted downward in order to close the gap too much, the added friction will not allow the panel to slide freely.

Many attempts to just add brushes to reduce the friction will allow water and air infiltration. Moreover many of these types of systems do not have a way to reduce air infiltration at the header, typically they have some type of guide block in the header profile that guides the panel as it is sliding and only have some type of brush that glides against the panel. Thus, many of these systems cannot be easily reconfigured to compensate for the wearing of the weather stripping, or the gradual shifting of a door frame.

Some systems include relatively large lever handles on each door panel to allow a user to raise and lower the panel slightly (such as raised for sliding, lowered for sealing). Moreover, most of these systems cannot be adjusted via the wheels to compensate for a non-level floor. This means that once the panel is lowered to the sealing position, the panel resting on the non-level floor will not be level. On larger panels this becomes an issue due to the fact that the leading edge will not rest plumb against the jamb, which may prevent the panel interlockers from sealing and thereby allowing air infiltration.

One trend in the sliding door industry is to automate these systems so that a motor pulls and/or pushes all the panels open at the touch of a button. However, attempts to combine automated open and closure systems with a system that lowers to seal can be cost prohibitive. In certain instances, for example, the large handle required to leverage the heavy panels into the up and down positions that are mounted on each panel hinders the panel stack (e.g., many panels going in one direction) from stacking flush to each other in the open position. Moreover, in some instances, large handles may prevent the panels from going all the way into the pocket.

BRIEF SUMMARY OF THE INVENTION

The present application discloses various embodiments of a sliding door assembly having a sliding door that moves laterally relative to a seal while remaining substantially perpendicular to an underlying floor in order to remove friction and wear from the seal when the sliding door is sliding.

An embodiment of a sliding door assembly may include a door panel and a frame that supports the door panel and includes a bottom member with a lower profile and a top member with an upper profile, wherein the lower profile and the upper profile are parallel to one another. A lower sliding assembly may be operatively coupled to a bottom of the door panel and engaging the lower profile, and an upper sliding assembly may be operatively coupled to a top of the door panel and engaging the upper profile. A gasket may interpose the door panel and a portion of the frame when the door panel is in a sealed position. The door panel may be movable between the sealed position, where the gasket creates a sealed interface between the door panel and the frame, and a sliding position, where the door panel is moved laterally away from the frame while remaining substantially perpendicular to a floor.

In certain embodiments including but not limited to in combination with the embodiments above and below, the sliding door assembly may further include a raised lip provided on the frame, wherein the gasket is positioned on at least a portion of the raised lip. At least one of the lower profile and the upper profile may include a rail that is angled towards the raised lip.

In certain embodiments including but not limited to in combination with the embodiments above and below, the sliding door assembly may further include a handle that is manually articulable to transition the door panel between the sealed position and the sliding position.

In certain embodiments including but not limited to in combination with the embodiments above and below, the lower and upper sliding assemblies may each comprise a carriage and one or more wheels rotatably mounted to the carriage, and the one or more wheels of the lower and upper sliding assemblies may be engageable with the lower profile and the upper profile, respectively. The lower and upper sliding assemblies may be movable between a tilted configuration, where the one or more wheels of the lower and upper sliding assemblies are tilted at an angle offset from perpendicular, and a vertical configuration, where the one or more wheels of the lower and upper sliding assemblies are substantially perpendicular to horizontal. The sliding door assembly may further include a handle that is manually articulable to transition lower and upper sliding assemblies between the tilted and vertical configurations, wherein, when the lower and upper sliding assemblies are in the tilted configuration, the door panel is in the sealed position, and wherein, when the lower and upper sliding assemblies are in the vertical configuration, the door panel is in the sliding position. A first vertical strut may extend from the handle, a lower horizontal bracket may be pivotably coupled to the first vertical strut and engageable with the lower sliding assembly, a second vertical strut may extend from the handle, and an upper horizontal bracket pivotably coupled to the second vertical strut and engageable with the upper sliding assembly.

In certain embodiments including but not limited to in combination with the embodiments above and below, the sliding door assembly may further a dynamic wedge coupled to the door panel, and a stationary wedge coupled to the frame, wherein the door panel is movable to the sealed position by slidably engaging opposing angled surfaces of the dynamic and stationary wedges and thereby urging the door panel laterally toward the frame and the gasket. The lower and upper sliding assemblies may each be coupled to the door panel at a shifting axle that allows the lower and upper sliding assemblies to shift laterally along the shifting axle as the door panel is transitioned between the sliding and sealed position. In other embodiments, the lower and upper sliding assemblies may each comprise a carriage and one or more wheels rotatably mounted to the carriage at an axle, wherein the one or more wheels shift laterally within the carriage as the door panel is transitioned between the sliding and sealed positions.

In certain embodiments including but not limited to in combination with the embodiments above and below, the lower and upper sliding assemblies may be movable between a tilted configuration, where the one or more wheels of the lower and upper sliding assemblies are tilted at an angle offset from perpendicular, and a vertical configuration, where the one or more wheels of the lower and upper sliding assemblies are substantially perpendicular to horizontal. The sliding door assembly may further a biasing assembly operatively coupled to each of the lower and upper sliding assemblies and providing a constant biasing force that urges the lower and upper sliding assemblies toward the vertical configuration. The biasing assembly may be dynamic and stationary wedges and may be included.

In certain embodiments including but not limited to in combination with the embodiments above and below, the lower and upper sliding assemblies may each comprise a carriage pivotably coupled to the door panel and one or more wheels rotatably mounted to the carriage. Moreover, the lower profile and the upper profile may each include a rail engageable with the one or more wheels of the lower and upper sliding assemblies, respectively, and the rail provides a bent section angled to laterally shift the door panel to the sealing position as the one or more wheels traverse the bent section.

The present disclosure also provides for a method of operating a sliding door assembly. The sliding door assembly can include a door panel, a frame that supports the door panel and includes a bottom member with a lower profile and a top member with an upper profile parallel to the lower profile, a lower sliding assembly operatively coupled to a bottom of the door panel and engaging the lower profile, and an upper sliding assembly operatively coupled to a top of the door panel and engaging the upper profile. The method may include placing the door panel in a sealed position, where a gasket interposing the door panel and a portion of the frame creates a sealed interface between the door panel and the frame, and moving the door panel to a sliding position by moving the door panel laterally away from the frame while the door panel remains substantially perpendicular to a floor.

In certain embodiments including but not limited to in combination with the embodiments above and below, moving the door panel to the sliding position may include manually articulating a handle that is operatively coupled to the lower and upper sliding assemblies. The lower and upper sliding assemblies may each comprise a carriage and one or more wheels rotatably mounted to the carriage, and the one or more wheels of the lower and upper sliding assemblies may be engageable with the lower profile and the upper profile, respectively. Moving the door panel to the sliding position may further include moving the lower and upper sliding assemblies between a tilted configuration, where the one or more wheels of the lower and upper sliding assemblies are tilted at an angle offset from perpendicular, and a vertical configuration, where the one or more wheels of the lower and upper sliding assemblies are substantially perpendicular to horizontal. The method may further include providing a constant biasing force that urges the lower and upper sliding assemblies toward the vertical configuration with a biasing assembly operatively coupled to each of the lower and upper sliding assemblies.

In certain embodiments including but not limited to in combination with the embodiments above and below, the sliding door assembly may further include a dynamic wedge coupled to the door panel and a stationary wedge coupled to the frame, and placing the door panel in the sealed position may include slidably engaging opposing angled surfaces of the dynamic and stationary wedges and thereby urging the door panel laterally toward the frame and the gasket. The biasing assembly or force may be dynamic and stationary wedges and may be included.

In certain embodiments including but not limited to in combination with the embodiments above and below ments, the lower and upper sliding assemblies may each comprise a carriage pivotably coupled to the door panel and one or more wheels rotatably mounted to the carriage, wherein the lower profile and the upper profile each include a rail engageable with the one or more wheels of the lower and upper sliding assemblies, respectively. Placing the door panel in the sealed position may comprise traversing a bent section of the rail with the one or more wheels, the bent section being angled to laterally shift the door panel to the sealing position.

In certain embodiments including but not limited to in combination with the embodiments above and below, the lower profile and the upper profile each include a rail upon which the lower and upper sliding assemblies ride and the rail is angled toward the gasket. The angled rail may urge lateral movement of the door panel to the sealed position.

DETAILED DESCRIPTION

Figure 1A:
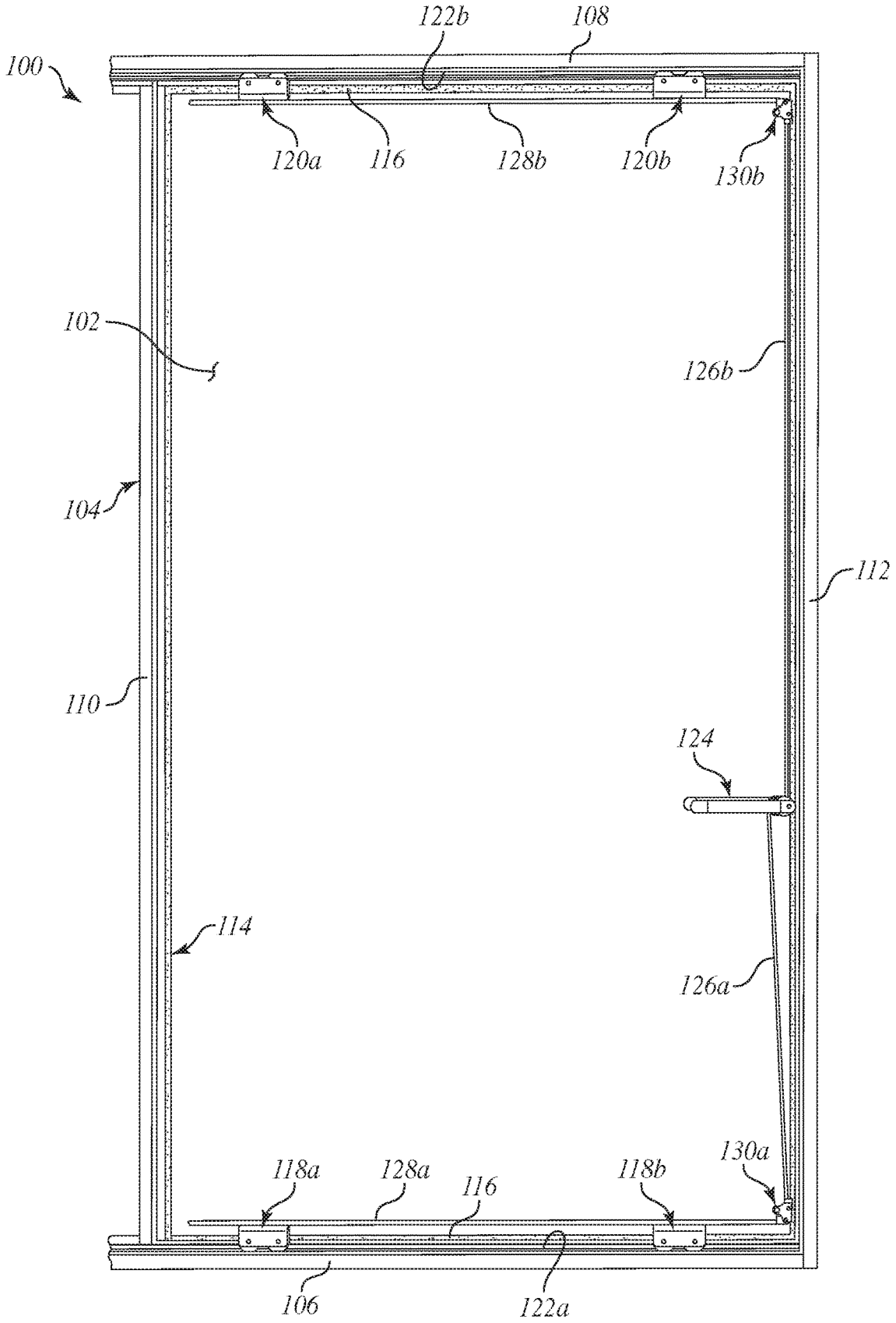
FIGS. 1A and 1B are partially exposed front views of an example sliding door assembly.
Figure 1B:
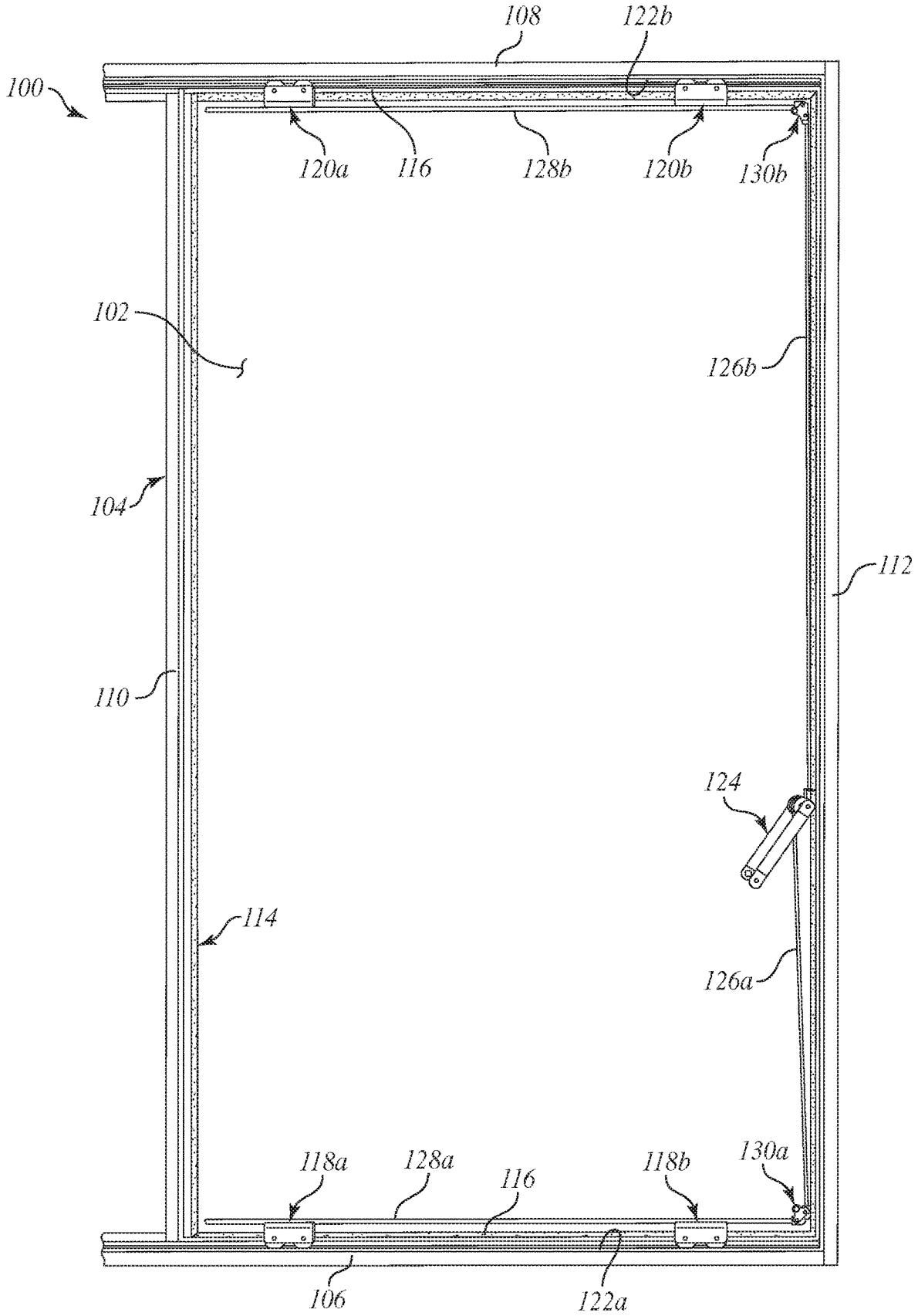

FIGS. 1A and 1B are partially exposed front views of an example sliding door assembly 100, according to one or more embodiments. More specifically, FIG. 1A shows the sliding door assembly 100 (hereafter the "assembly 100") in a sealed position (alternately referred to as the "closed" position), and FIG. 1B shows the assembly 100 in a sliding position (alternately referred to as the "open" position). As illustrated, the assembly 100 includes a door panel 102 and a rectangular frame 104 that supports the door panel 102. In the illustrated view, the front portion of the door panel 102 is removed to expose the interior mechanisms and operation of the assembly 100.

The frame 104 includes a bottom member 106, a top member 108, and opposing side members 110 and 112 that extend between the bottom and top members 106, 108. A continuous or semi-continuous raised lip 114 may be provided and otherwise defined on some or all of the frame 104 and extend inward toward the center of the frame 104. In some embodiments, for example, the raised lip 114 may be provided on only the bottom and top members 106, 108. In other embodiments, however, the raised lip 114 may be provided on the bottom and top members 106, 108 and the opposing side members 110 and 112.

A gasket 116 may be positioned on some or all of the raised lip 114 to facilitate a sealed interface between the door panel 102 and the frame 104 when the door panel 102 is moved into lateral engagement therewith and otherwise placed in the sealed position. The gasket 116 may be made of any pliable material suitable for facilitating a fluid tight seal, such as an elastomer. In some embodiments, the gasket 116 may be provided on the raised lip 114 of only the bottom and top members 106, 108. In other embodiments, however, the gasket 116 may be provided on the bottom and top members 106, 108 and the opposing side members 110 and 112. In such embodiments, the door panel 102 may be substantially sealed about its periphery when placed in the sealed position.

While the gasket 116 is shown and described herein as being secured to or otherwise positioned on the raised lip 114, it is contemplated herein to alternatively place the gasket 116 on the door panel 102, without departing from the scope of the disclosure. In such embodiments, the door panel 102 may move the gasket 116 into lateral engagement with the frame 104 (e.g., the raised lip 114) to generate a sealed interface. Accordingly, the gasket 116 may be generally characterized as being positioned between (interposing) the door panel 102 and the frame 104 and, more specifically, between the door panel 102 and the raised lip 114 of the frame 104.

While not depicted in FIGS. 1A and 1B, the door panel 102 may include a panel frame that surrounds the periphery of the door panel 102. In some embodiments, the panel frame may be integrally formed with the door panel 102 and otherwise form part thereof. In other embodiments, however, the panel frame may comprise a separate structure (or structures) operatively coupled to the door panel 102 about some or all of its periphery. In such embodiments, for example, the panel frame may include a lower panel member operatively coupled to a bottom of the door panel 102, an upper panel member operatively coupled to a top of the door panel 102, and opposing side panel members operatively coupled to each side of the door panel 102.

The door panel 102 may include a plurality of sliding assemblies that enable the door panel 102 to slide or roll horizontally relative to the frame 104 when placed in the sliding position. As used herein, the term "sliding assemblies," "sliding assembly," and any variations thereof, generally refer to any mechanism capable of assisting the door panel 102 to slide (with or without a wheel) and/or roll horizontally relative to the frame 104. While the disclosure describes sliding assemblies that incorporate wheels rotatably mounted on axles, it is contemplated herein to employ other types of sliding assemblies, such as sliding assemblies that incorporate ball bearings, or a sliding assembly that does not have a wheel such as a wheel-less track system without departing from the scope of the disclosure.

One or more lower sliding assemblies, shown as a first lower sliding assembly 118*a* and a second lower sliding assembly 118*b*, may be arranged at the bottom of the door panel 102, and one or more upper sliding assemblies, shown as a first upper sliding assembly 120*a* and a second upper sliding assembly 120*b*, may be arranged at the top of the door panel 102. While two lower and upper sliding assemblies 118*a,b* and 120*a,b*, respectively, are depicted in FIGS. 1A-1B, it is contemplated herein to employ more or less than two, without departing from the scope of the disclosure. Each of the lower and upper sliding assemblies 118*a,b* and 120*a,b* may be generally similar in construction and will be described in more detail below.

In some embodiments, the lower and upper sliding assemblies 118*a,b* and 120*a,b* may be directly coupled to the bottom and the top of the door panel 102, respectively. In other embodiments, however, the lower sliding assemblies 118*a,b* may be coupled to the lower panel member of the door panel 102, and the upper sliding assemblies 120*a,b* may be coupled to upper panel member of the door panel 102. In either scenario, the lower and upper sliding assemblies 118*a,b* and 120*a,b* may be characterized as being operatively coupled to the bottom and the top of the door panel 102, respectively.

The frame 104 may further include a lower profile 122*a* and an upper profile 122*b*, where the lower and the upper profile 122*a,b* are generally parallel to each other. As used herein, the term "profile," "profiles," and any variations thereof including but not limited to "lower profile" and "upper profile", generally refer to any mechanism capable of assisting the door panel to be retained to the frame including but not limited to a track, a track system, a wheel or wheel system, a rail, and/or a slot. Even though a track and rail are disclosed other variations are contemplated. The lower profile 122*a* may be coupled to or form part of the bottom member 106, and the upper profile 122*b* may be coupled to or form part of the upper member 108. The lower sliding assemblies 118*a,b* may be engageable with the lower profile 122*a*, and the upper sliding assemblies 120*a,b* may be engageable with the upper profile 122*b*.

The assembly 100 is capable of transitioning the door panel 102 between the sealed position, as shown in FIG. 1A, and the sliding position, as shown in FIG. 1B. When the assembly 100 is in the sealed position, the door panel 102 engages the gasket 116 and leakage around the perimeter of the door panel 102 is substantially or entirely eliminated. In contrast, when the door panel 102 is in the sliding position, the door panel 102 is moved laterally away from the gasket 116 while remaining substantially perpendicular to an underlying floor (e.g., below or flush with the bottom member 106). Once in the sliding position, a gap or space may be formed between the door panel 102 and the frame 104, which allows the door panel 102 to freely translate (roll, slide, etc.) horizontally relative to the frame 104.

To help transition the door panel 102 between the sealed and sliding positions, the assembly 100 may include a handle 124 that is manually articulable between a first position, as shown in FIG. 1A, and a second position, as shown in FIG. 1B. The handle 124 may be operatively coupled to the lower sliding assemblies 118*a,b* via a first vertical strut 126*a* and a lower horizontal bracket 128*a*, where the first vertical strut 126*a* and the lower horizontal bracket 128*a* are pivotably coupled at a first pivot coupling 130*a*. Similarly, the handle 124 may be operatively coupled to the upper sliding assemblies 120*a,b* via a second vertical strut 126*b* and an upper horizontal bracket 128*b*, where the second vertical strut 126*b* and the upper horizontal bracket 128*b* are pivotably coupled at a second pivot coupling 130*b*.

Figure 4A:
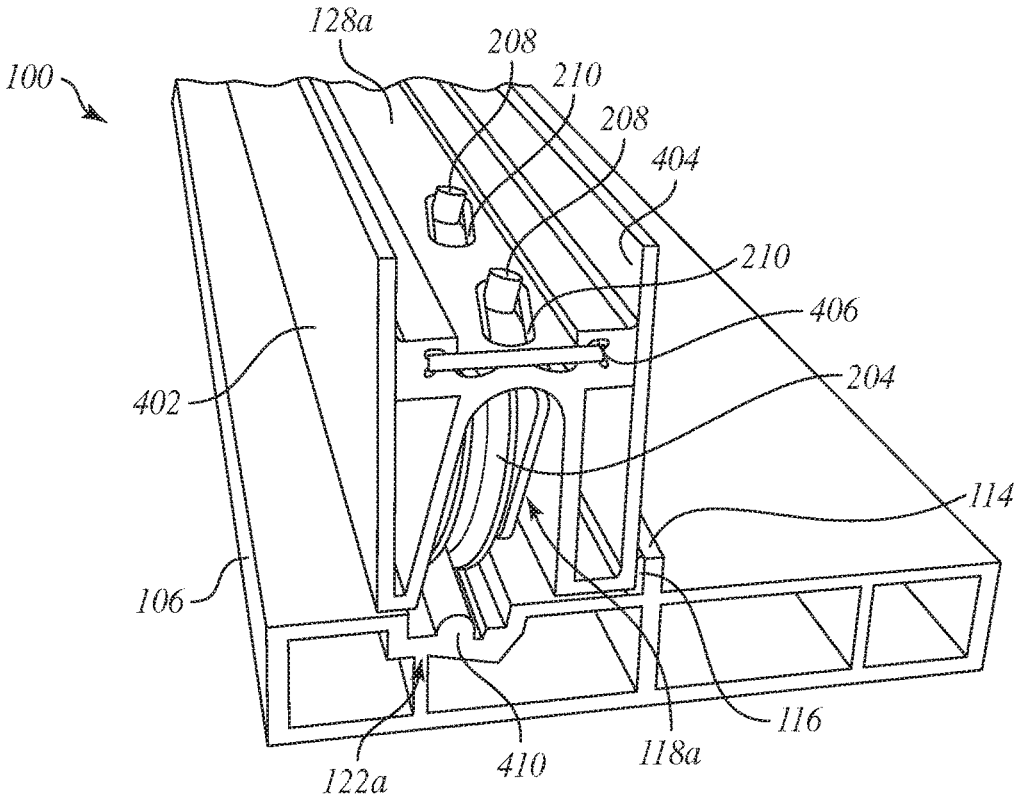
FIGS. 4A and 4B are enlarged cross-sectional end views of yet another portion of the assembly of FIGS. 1A-1B.
Figure 4B:
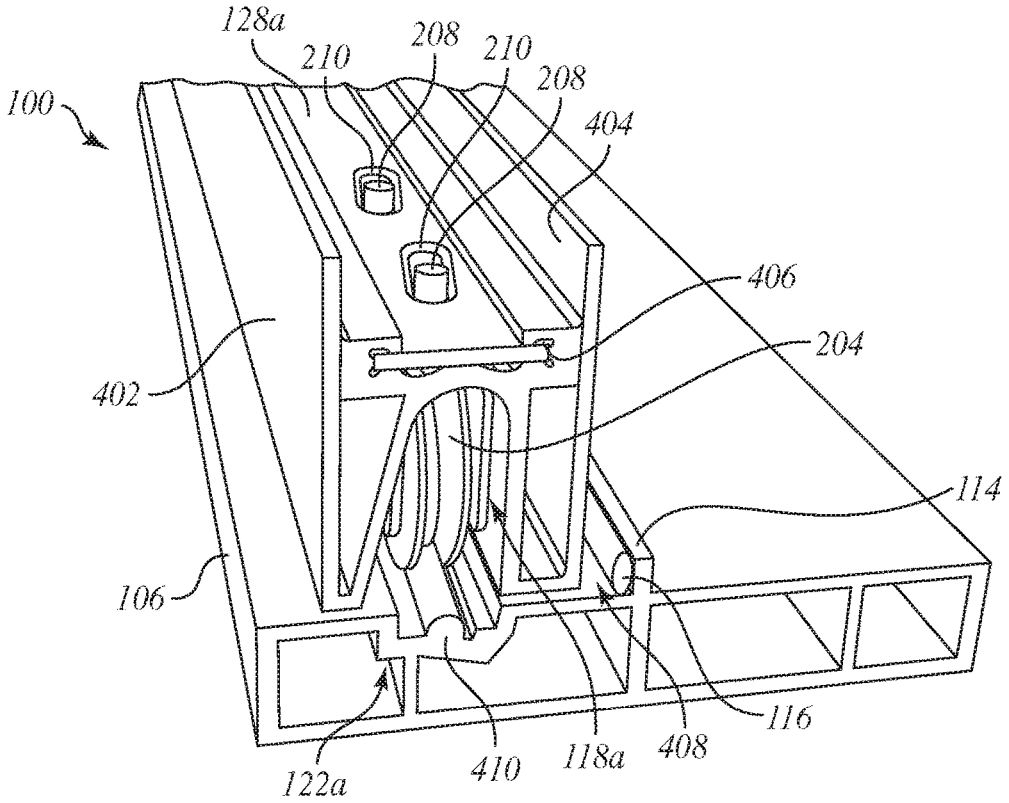

The lower and upper horizontal brackets 128*a,b* may be engageable with the lower and upper sliding assemblies 118*a,b* and 120*a,b*, respectively, such that horizontal movement of the lower and upper horizontal brackets 128*a,b* correspondingly causes the lower and upper sliding assemblies 118*a,b* and 120*a,b* to actuate (move). More specifically, horizontal translation of the lower and upper horizontal brackets 128*a,b* causes the lower and upper sliding assemblies 118*a,b* and 120*a,b*, respectively, to move from a tilted configuration, as shown in FIG. 4A, to a vertical configuration, as shown in FIG. 4B. When the lower and upper sliding assemblies 118*a,b* and 120*a,b* are in the tilted configuration, the door panel 102 is urged into lateral engagement with the gasket 116. In contrast, when the lower and upper sliding assemblies 118*a,b* and 120*a,b* are moved to the vertical configuration, the door panel 102 is correspondingly moved laterally from the gasket 116, and thereby frees the door panel 102 to translate (roll, slide, etc.) horizontally relative to the frame 104. Accordingly, moving the handle 124 to the second position correspondingly transitions the door panel 102 from the sealing position to the sliding position.

Figure 2A:
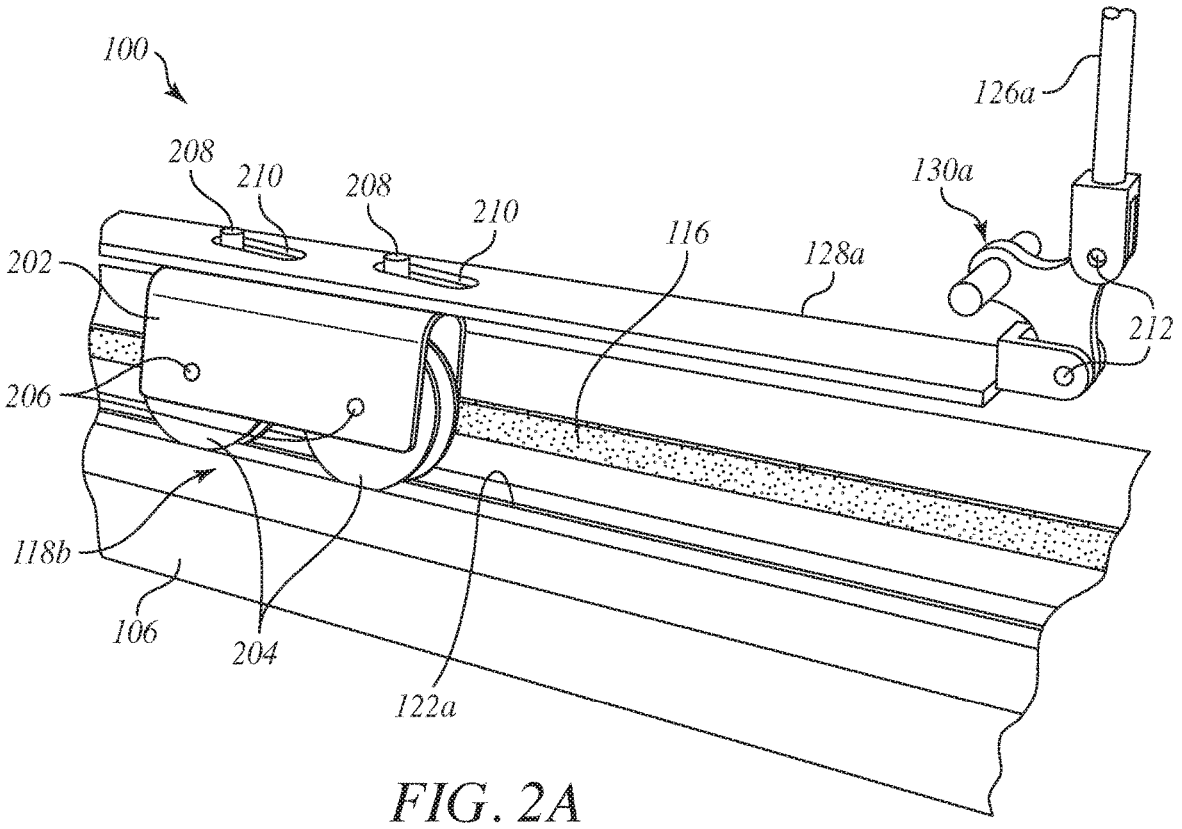
FIGS. 2A and 2B are enlarged isometric views of a portion of the assembly of FIGS. 1A-1B.
Figure 2B:
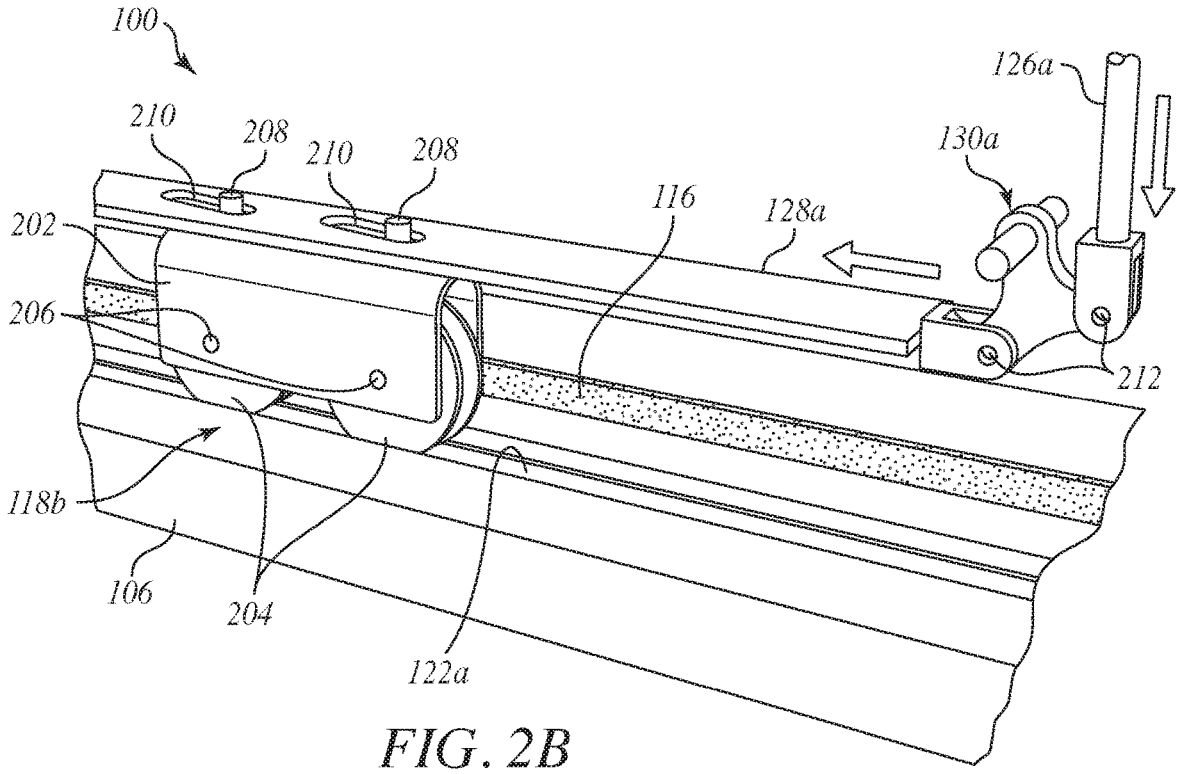

FIGS. 2A and 2B are enlarged isometric views of a portion of the assembly 100, according to one or more embodiments. More specifically, FIGS. 2A and 2B depict the second lower sliding assembly 118*b* in the tilted and vertical configurations, respectively. The second lower sliding assembly 118*b* may be representative of any or each of the lower and upper sliding assemblies 118*a,b* and 120*a,b* described herein. Accordingly, for the sake of brevity only the second lower sliding assembly 118*b* will be described, but such description is equally applicable to any or each of the lower and upper sliding assemblies 118*a,b* and 120*a,b*.

As illustrated, the second lower sliding assembly 118*b* includes a carriage 202 and one or more wheels 204 (two shown) rotatably mounted to the carriage 202 via a corresponding one or more axles 206 (two shown). While two wheels 204 are depicted, it is contemplated herein to incorporate more or less than two wheels 204, without departing from the scope of the disclosure. The wheels 204 may be configured to engage and roll against the lower profile 122*a* of the bottom member 106.

One or more pins 208 (two shown) may extend from the carriage 202 to be received within a corresponding one or more slots 210 (two shown) defined in the lower horizontal bracket 128*a*. The slots 210 may be angled and the pins 208 may be configured to slide within the slots 210 when the lower horizontal bracket 128*a* moves horizontally. The angled nature of the slots 210 urges the second lower sliding assembly 118*b* to transition between the tilted and vertical configurations as the lower horizontal bracket 128*a* moves.

In example operation, the handle 124 (FIGS. 1A-1B) may be manually articulated, which causes the first vertical strut 126*a* to move downward and act on the first pivot coupling 130*a*. The first pivot coupling 130*a* may be pivotably coupled to the first vertical strut 126*a* and the lower horizontal bracket 128*a* at corresponding pivot joints 212. As the first vertical strut 126*a* moves downward, the first pivot coupling 130*a* pivots and correspondingly moves the lower horizontal bracket 128*a* horizontally relative to the second lower sliding assembly 118*b*. As the lower horizontal bracket 128*a* moves in the horizontal direction, the pins 208 slide (translate) within the angled slots 210 and thereby move the second lower sliding assembly 118*b* from the tilted configuration to the vertical configuration, which causes the door panel 102 (FIGS. 1A-1B) to move laterally from and otherwise disengage the gasket 116.

Figure 3A:
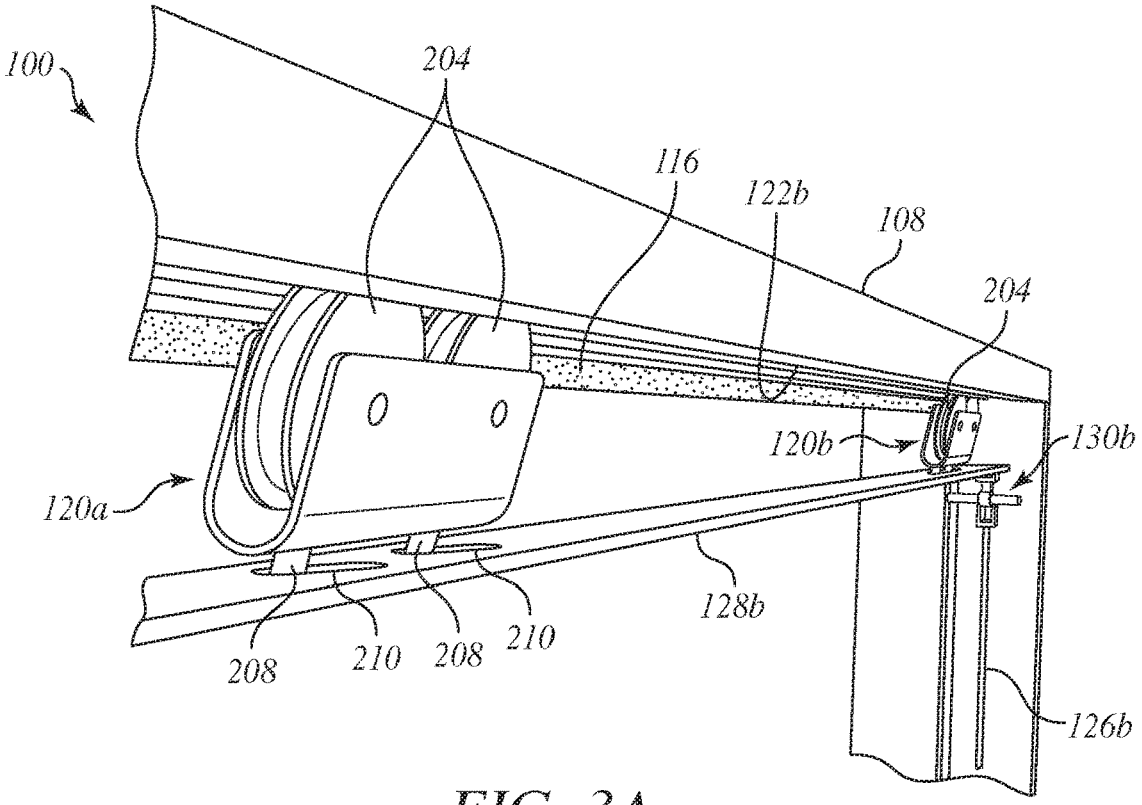
FIGS. 3A and 3B are enlarged perspective views of another portion of the assembly of FIGS. 1A-1B.
Figure 3B:
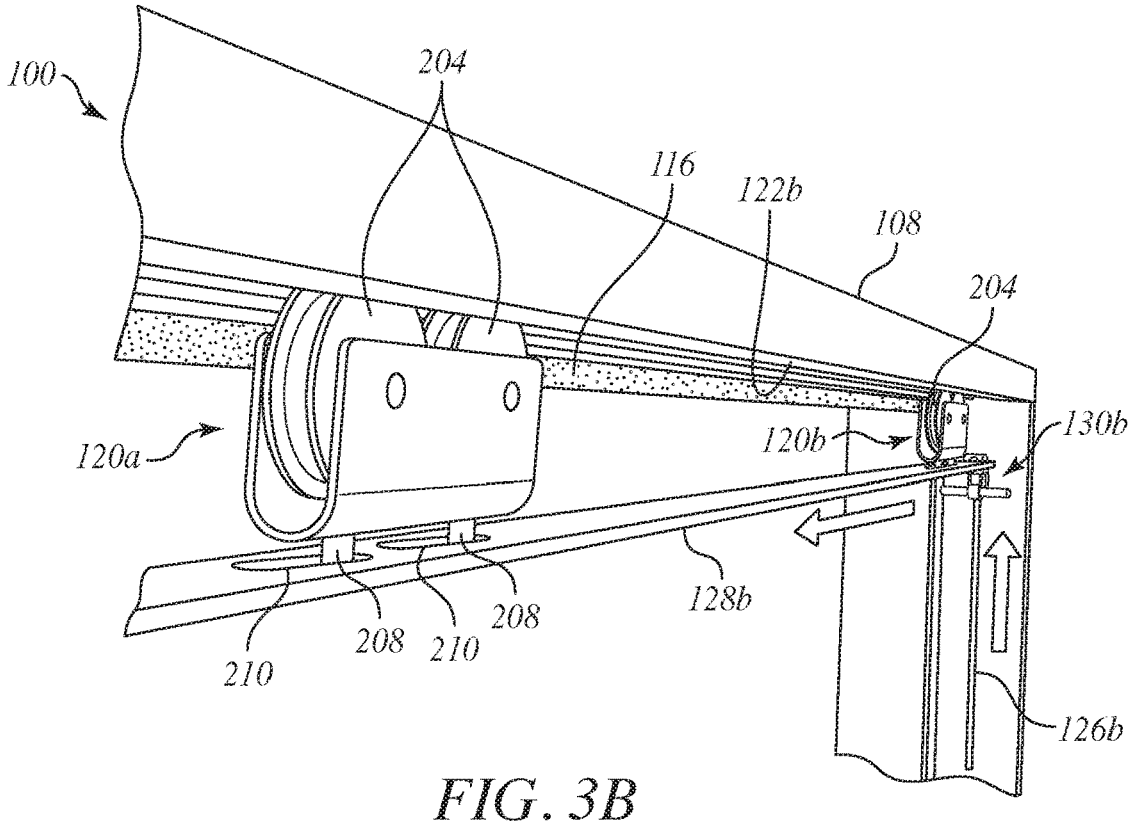

FIGS. 3A and 3B are enlarged perspective views of another portion of the assembly 100, according to one or more embodiments. More specifically, FIGS. 3A and 3B depict the upper sliding assemblies 120*a,b* in the tilted and vertical configurations, respectively. As illustrated, the wheels 204 of each upper sliding assembly 120*a,b* engage and roll against the upper profile 122*b* of the upper member 108. Moreover, the pins 208 of each upper sliding assembly 120*a,b* extend through corresponding slots 210 defined in the upper horizontal bracket 128*b*, and the slots 210 are angled such that as the pins 208 slide within the slots 210 the upper sliding assemblies 120*a,b* are transitioned (urged) between the tilted and vertical configurations.

In example operation, the handle 124 (FIGS. 1A-1B) may be manually articulated to cause the second vertical strut 126*b* to move upward and act on the second pivot coupling 130*b*, which is pivotably coupled to the second vertical strut 126*b* and the upper horizontal bracket 128*b*. As the second vertical strut 126*b* moves upward, the second pivot coupling 130*b* pivots and correspondingly moves the upper horizontal bracket 128*b* horizontally relative to the upper sliding assemblies 120*a,b*. As the upper horizontal bracket 128*b* moves in the horizontal direction, the pins 208 slide (translate) within the angled slots 210 and thereby move the upper sliding assemblies 120*a,b* from the tilted configuration to the vertical configuration, which causes the door panel 102 (FIGS. 1A-1B) to move laterally from and otherwise disengage the gasket 116.

FIGS. 4A and 4B are enlarged cross-sectional end views of yet another portion of the assembly 100, according to one or more embodiments. More specifically, FIGS. 4A and 4B depict the first lower sliding assembly 118*a* in the tilted and vertical configurations, respectively. As with the description of the second lower sliding assembly 118*b* of FIGS. 2A-2B, and for the sake of brevity, the following description of the first lower sliding assembly 118*a* may be representative of any or each of the lower and upper sliding assemblies 118*a,b* and 120*a,b* described herein.

In the illustrated embodiment, the first lower sliding assembly 118*a* is operatively coupled to a lower panel member 402 that is arranged adjacent (e.g., atop) the bottom member 106 of the frame 104 (FIGS. 1A-1B). As discussed above, the lower panel member 402 may form part of a panel frame that surrounds the periphery of the door panel 102 (FIGS. 1A-1B). Moreover, the lower panel member 402 may be integrally formed with the bottom of the door panel 102 or otherwise may be coupled thereto. In at least one embodiment, for example, the bottom of the door panel 102 may be received or otherwise seated within a trough 404 defined by the lower panel member 402. Accordingly, the lower panel member 402 may be considered part of the door panel 102 such that moving the lower panel member 402 laterally or horizontally relative to the bottom member 106 is equivalent to moving the door panel 102 in the same direction.

As illustrated, the lower horizontal bracket 128*a* may be operatively coupled to the lower panel member 402. More particularly, the lower horizontal bracket 128*a* may be slidably received within a channel 406 sized to receive the lower horizontal bracket 128*a*. As received within the channel 406, any lateral movement of the lower horizontal bracket 128*a* resulting from the pins 208 sliding within the angled slots 210 will correspondingly move the lower panel member 402 in the same direction.

In example operation, when the handle 124 (FIGS. 1A-1B) is articulated, the lower horizontal bracket 128*a* translates horizontally relative to the first lower sliding assembly 118*a* and the lower panel member 402. As the lower horizontal bracket 128*a* moves in the horizontal direction, the pins 208 slide (translate) within the angled slots 210 and thereby pivot the first lower sliding assembly 118*a* from the tilted configuration (FIG. 4A) to the vertical configuration (FIG. 4B). In the tilted configuration, the wheels 204 are tilted at an angle offset from perpendicular to the bottom member 106 and otherwise at an angle between vertical and horizontal. In contrast, in the vertical configuration, the wheels 204 may be arranged substantially perpendicular to the bottom member 106 and otherwise perpendicular to horizontal.

Sliding the pins 208 within the angled slots 210 also simultaneously causes the lower panel member 402 to move laterally away from the raised lip 114, which disengages the lower panel member 402 (e.g., the door panel 102 of FIGS. 1A-1B) from the gasket 116 and creates a space 408 (FIG. 4B) between the gasket 116 and the lower panel member 402. Once the lower panel member 402 (e.g., the door panel 102) is separated from the gasket 116, the door panel 102 is able to freely translate (roll, slide, etc.) horizontally relative to the bottom member 106.

Accordingly, FIGS. 4A and 4B also show the assembly 100 transitioning between the sealed position (FIG. 4A) and the sliding position (FIG. 4B). The assembly 100 may be transitioned back to the sealed position by reversing the foregoing process. More specifically, moving the lower horizontal bracket 128*a* in the opposing horizontal direction will reverse the above process and thereby bring the lower panel member 402 (e.g., the door panel 102 of FIGS. 1A-1B) back into compressed and sealing engagement with the gasket 116.

The lower profile 122*a* may include a rail 410 that the wheels 204 engage. In one or more embodiments, as illustrated, the rail 410 may be angled toward the raised lip 114 and otherwise at an angle between vertical and horizontal. Having the rail 410 angled toward the raised lip 114 may prove advantageous in helping urge lateral movement of the lower panel member 402 (e.g., the door panel 102 of FIGS. 1A-1B) back toward the sealed position (FIG. 4A).

While FIGS. 4A and 4B describe operation of the first lower sliding assembly 118*a* in conjunction with the lower panel member 402, it will be appreciated that the foregoing discussion is equally applicable to the second lower sliding assembly 118*b* (FIGS. 1A-1B and 2A-2B). Moreover, the foregoing description equally applies to operation and actuation of the upper sliding assemblies 120*a,b* (FIGS. 1A-1B and 3A-3B) in conjunction with a corresponding upper panel member, without departing from the scope of the disclosure.

Figure 5A:
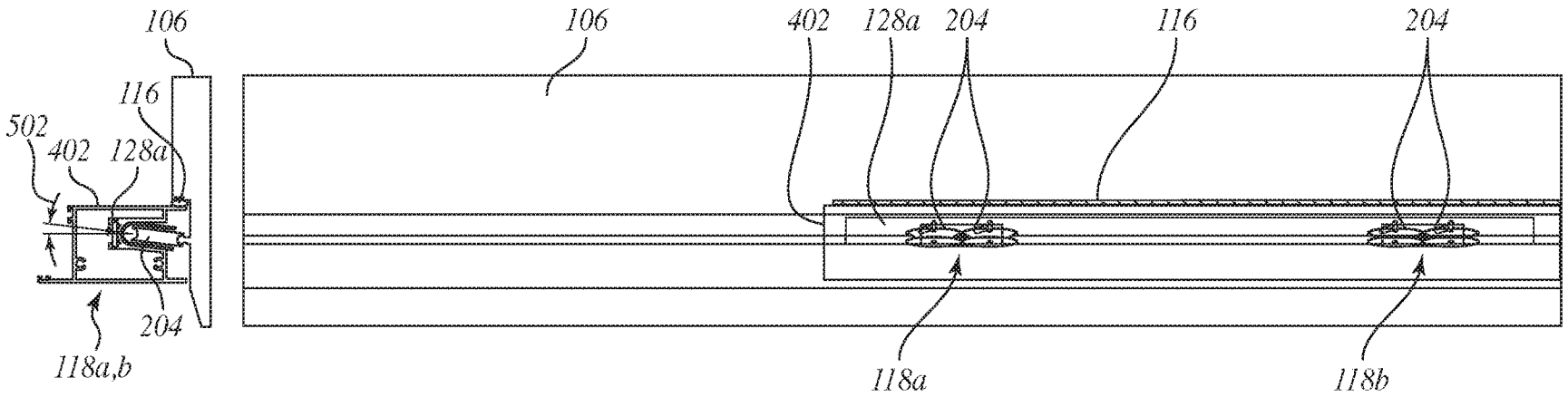
FIGS. 5A and 5B are combined schematic end and top views of the lower sliding assemblies of FIGS. 1A-1B in the tilted and vertical configurations, respectively.
Figure 5B:
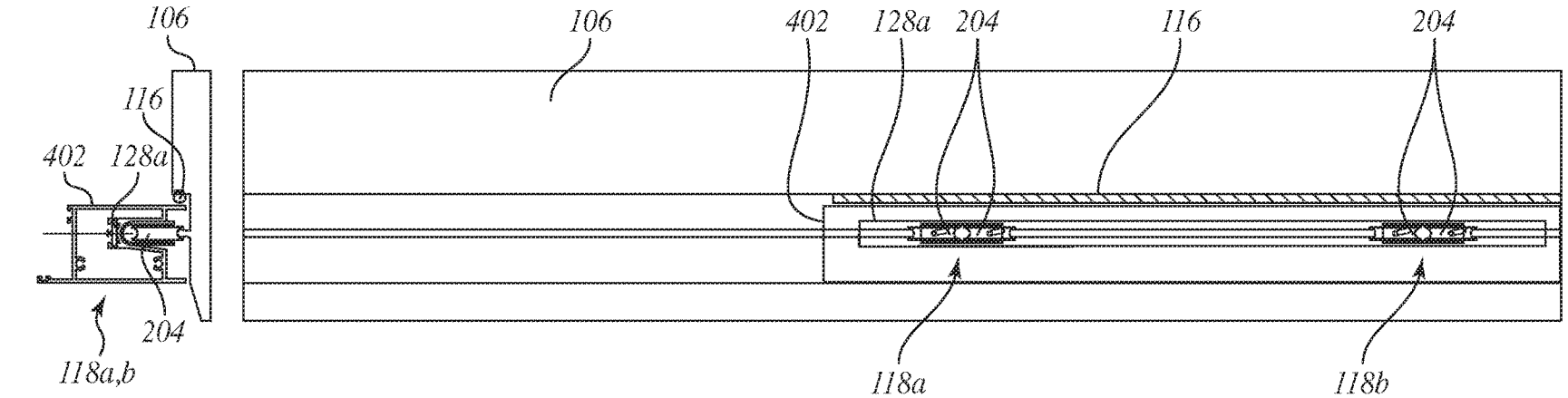

FIGS. 5A and 5B are combined schematic end and top views of the lower sliding assemblies 118*a,b* of FIGS. 1A-1B in the tilted and vertical configurations, respectively. As illustrated, the lower sliding assemblies 118*a,b* are operatively coupled to the lower panel member 402, which is coupled to or forms part of the door panel 102 (FIGS. 1A-1B). The lower panel member 402 is arranged adjacent the bottom member 106, and the lower horizontal bracket 128*a* may be operatively and movably coupled to the lower panel member 402, as described above.

In FIG. 5A, the lower sliding assemblies 118*a,b* are in the tilted configuration, where the wheels 204 are tilted at an angle 502 offset from perpendicular to the bottom member 106 and otherwise at an angle 502 between vertical and horizontal. With the lower sliding assemblies 118*a,b* in the tilted configuration, the door panel 102 (FIGS. 1A-1B) may be in the sealed position, where the door panel 102 (e.g., the lower panel member 402) is in compressed and sealing engagement with the gasket 116.

In FIG. 5B, the lower sliding assemblies 118*a,b* are transitioned to the vertical configuration via actuation of the lower horizontal bracket 128*a*, as generally described above. In the vertical configuration, the wheels 204 are arranged vertically and otherwise substantially perpendicular to the bottom member 106 and perpendicular to horizontal. With the lower sliding assemblies 118*a,b* in the vertical configuration, the door panel 102 (FIGS. 1A-1B) may be in the sliding position, where the door panel 102 (e.g., the lower panel member 402) moves laterally away from and disengages the gasket 116 while remaining substantially perpendicular to an underlying floor (e.g., below or flush with the bottom member 106). Once the door panel 102 (e.g., the lower panel member 402) is separated from the gasket 116, the door panel 102 is able to freely translate (roll, slide, etc.) relative to the bottom member 106.

While FIGS. 5A and 5B describe operation of the lower sliding assemblies 118*a,b* in conjunction with the lower panel member 402, it will be appreciated that the foregoing discussion is equally applicable to the upper sliding assemblies 120*a,b* (FIGS. 1A-1B and 3A-3B) in conjunction with a corresponding upper panel member, without departing from the scope of the disclosure.

Figure 6A:
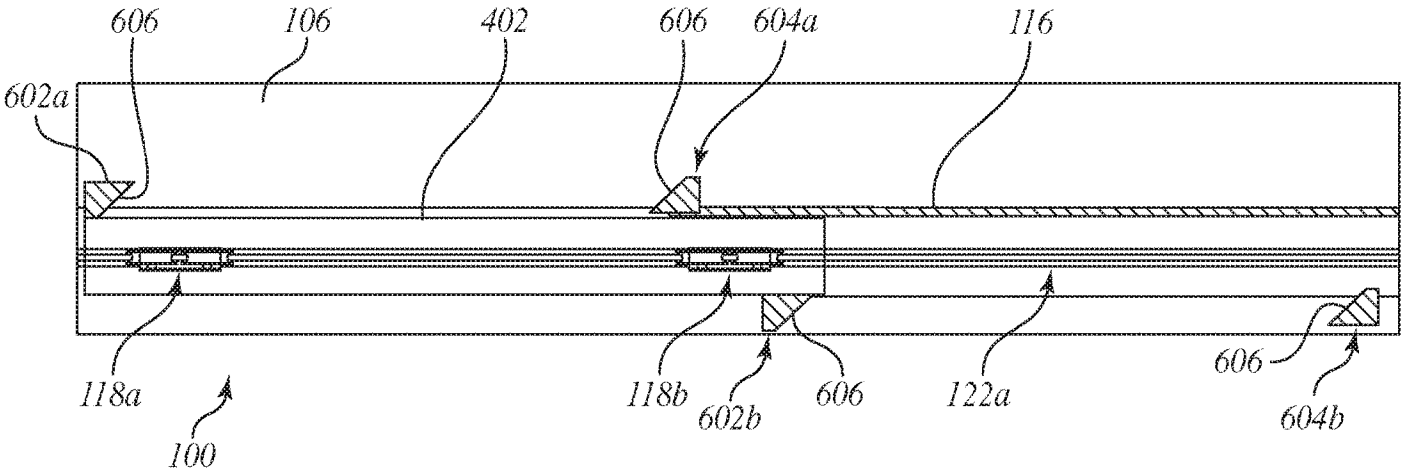
FIGS. 6A and 6B are schematic top views of another embodiment of the assembly of FIGS. 1A-1B.
Figure 6B:
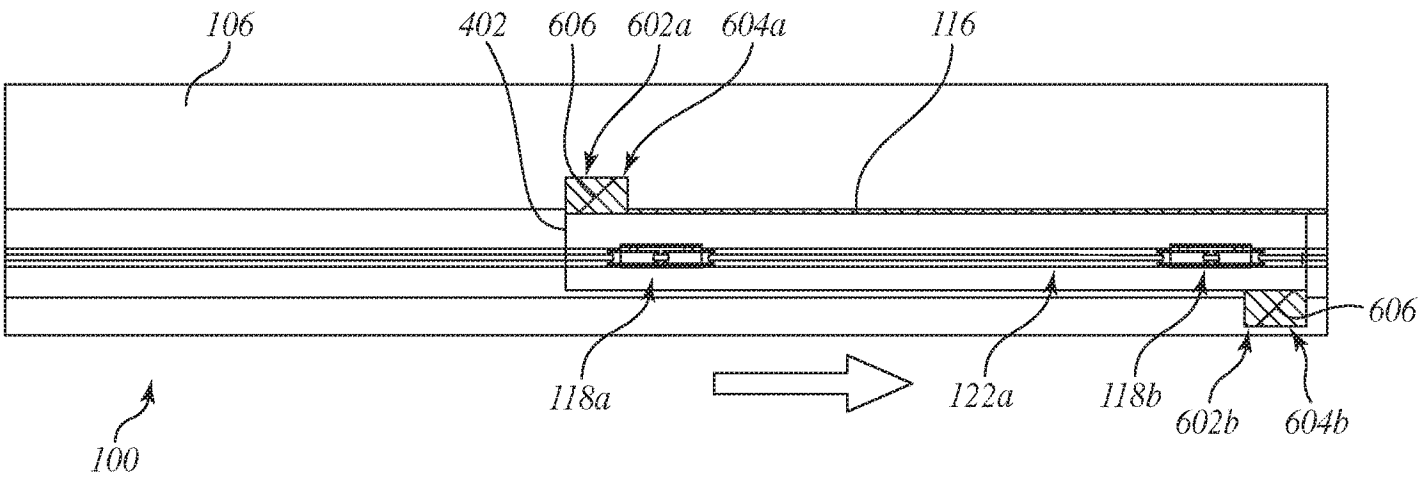

FIGS. 6A and 6B are schematic top views of another embodiment of the assembly 100, according to one or more additional embodiments. More specifically, FIGS. 6A and 6B depict a portion of the assembly 100 in the sliding (open) and sealed (closed) positions, respectively. In the illustrated embodiment, the lower sliding assemblies 118*a,b* are operatively coupled to and otherwise carried by the lower panel member 402, which is coupled to or forms part of the door panel 102 (FIGS. 1A-1B). As with prior embodiments, the lower panel member 402 is arranged adjacent the bottom member 106 and configured to move horizontally relative to bottom member 106 when in the sliding position.

The assembly 100 may further include one or more sets of opposing wedges to help transition the lower panel member 402 (e.g., the door panel 102 of FIGS. 1A-1B) between the sliding and sealed positions. More specifically, a first dynamic wedge 602*a* and a second dynamic wedge 602*b* may be coupled to or form part of the lower panel member 402 (e.g., the door panel 102 of FIGS. 1A-1B), and a first stationary wedge 604*a* and a second stationary wedge 604*b* may be coupled to or form part of the bottom member 106. The first and second dynamic wedges 602*a,b* may be positioned on opposite sides (e.g., front and back) of the lower panel member 402 (e.g., the door panel 102 of FIGS. 1A-1B), and the first and second stationary wedges 604*a,b* may be positioned on opposite sides of the lower profile 122*a*.

The first dynamic and stationary wedges 602*a*, 604*a* may comprise a first set of opposing wedges, and each may define an angled surface 606 configured to slidably engage the angled surface 606 of the opposing wedge. Similarly, the second dynamic and stationary wedges 602*b*, 604*b* may comprise a second set of opposing wedges, and each may also define an angled surface 606 configured to slidably engage the angled surface 606 of the opposing wedge. It should be noted that while two sets of opposing wedges are shown in FIGS. 6A-6B, more or less than two sets may be incorporated, without departing from the scope of the disclosure.

In FIG. 6A, the lower panel member 402 (e.g., the door panel 102 of FIGS. 1A-1B) is in the sliding (open) position and, therefore, is positioned laterally offset from the gasket 116. Consequently, the lower panel member 402 (e.g., the door panel 102) is free to move horizontally by sliding on the lower sliding assemblies 118*a,b*.

In FIG. 6B, the lower panel member 402 (e.g., the door panel 102 of FIGS. 1A-1B) has been moved horizontally to the sealing (closed) position and, therefore, has come into compressed and sealing engagement with the gasket 116. In some embodiments, the lower panel member 402 (e.g., the door panel 102) may be manually moved horizontally to the sealing position, such as by a user manually grasping a handle (e.g., the handle 124 of FIGS. 1A-1B) and pulling/pushing the lower panel member 402 (e.g., the door panel 102) toward the sealing position. In other embodiments, however, movement of the lower panel member 402 (e.g., the door panel 102) may be automated and otherwise powered by a motor and suitable gearing, without departing from the scope of the disclosure.

As the lower panel member 402 (e.g., the door panel 102 of FIGS. 1A-1B) moves to the sealing (closed) position, the dynamic and stationary wedges 602*a,b*, 604*a,b* will eventually come into contact with each other. The opposing angled surfaces 606 of each wedge are angled such that horizontal movement of the lower panel member 402 (e.g., the door panel 102) toward the sealing position urges the lower panel member 402 (e.g., the door panel 102) laterally toward the gasket 116 and eventually into compressed engagement therewith. The rebound (compressive) force of the gasket 116 and the opposing angled surfaces 606 of each wedge 602*a,b*, 604*a,b* may help separate the lower panel member 402 (e.g., the door panel 102) from the gasket 116 when it is desired to move back to the sliding (open) position.

While FIGS. 6A and 6B describe operation of the lower sliding assemblies 118*a,b* in conjunction with the lower panel member 402, it will be appreciated that the foregoing discussion is equally applicable to the upper sliding assemblies 120*a,b* (FIGS. 1A-1B and 3A-3B) in conjunction with a corresponding upper panel member, without departing from the scope of the disclosure.

Figure 7B:
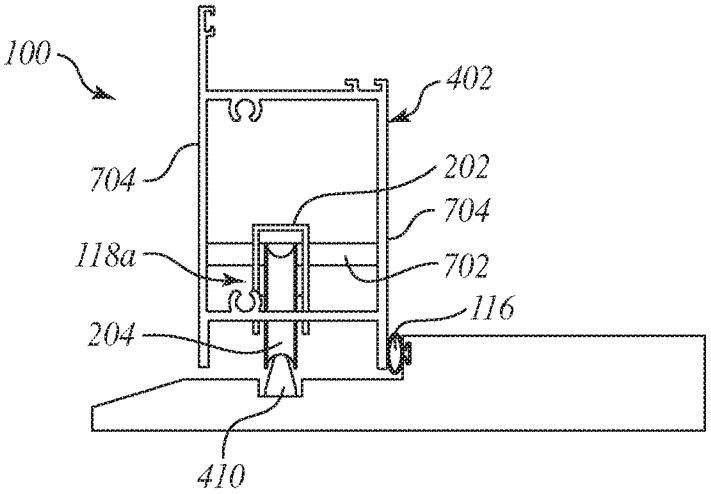
FIGS. 7A and 7B are schematic end views of one embodiment of the assembly of FIGS. 6A-6B.
Figure 7A:
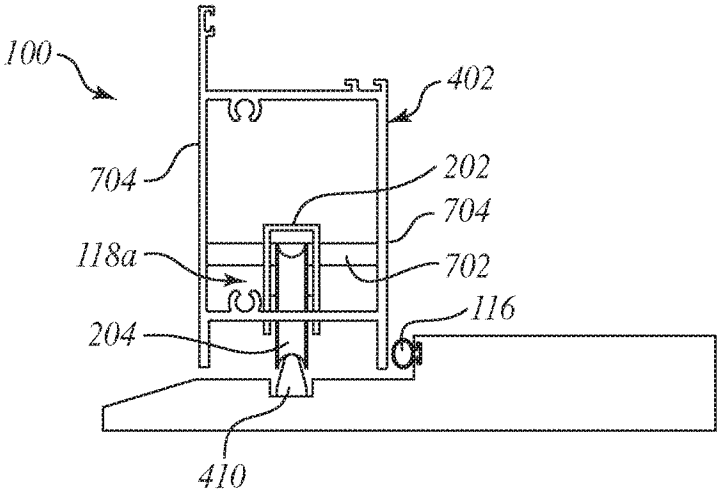

FIGS. 7A and 7B are schematic end views of an alternative embodiment of the assembly 100 of FIGS. 6A-6B. In the illustrated embodiment, the lower sliding assemblies 118*a,b* (only the first lower sliding assembly 118*a* visible) are operatively coupled to the lower panel member 402 by being slidably mounted to a shifting axle 702. More specifically, the shifting axle 702 may be secured to and extend laterally between opposing support members 704 of the lower panel member 402 (e.g., the door panel 102), and the carriage 202 of the first lower sliding assembly 118*a* may be mounted to the shifting axle 702. Mounting the carriage 202 to the shifting axle 702 may prove advantageous in allowing the first lower sliding assembly 118*a* to slide (shift) laterally along at least a portion of the shifting axle 702 during operation.

In FIG. 7A, the lower panel member 402 (e.g., the door panel 102 of FIGS. 1A-1B) is in the sliding (open) position and, therefore, is positioned laterally offset from the gasket 116. Consequently, the lower panel member 402 (e.g., the door panel 102) is free to move horizontally by sliding on the first lower sliding assembly 118*a*, which rides on the rail 410.

In FIG. 7B, the lower panel member 402 (e.g., the door panel 102 of FIGS. 1A-1B) has been moved (shifted) to the sealing (closed) position and, therefore, has come into compressed and sealing engagement with the gasket 116. The first lower sliding assembly 118*a*, however, does not correspondingly shift laterally with the lower panel member 402 (e.g., the door panel 102) since the wheels 204 are received within the rail 410. Rather, as the lower panel member 402 (e.g., the door panel 102) shifts laterally into the sealing position, the first lower sliding assembly 118*a* remains stationary and slides along the shifting axle 702. Consequently, the first lower sliding assembly 118*a* is able to remain relatively vertical in orientation during this process.

Figure 8B:
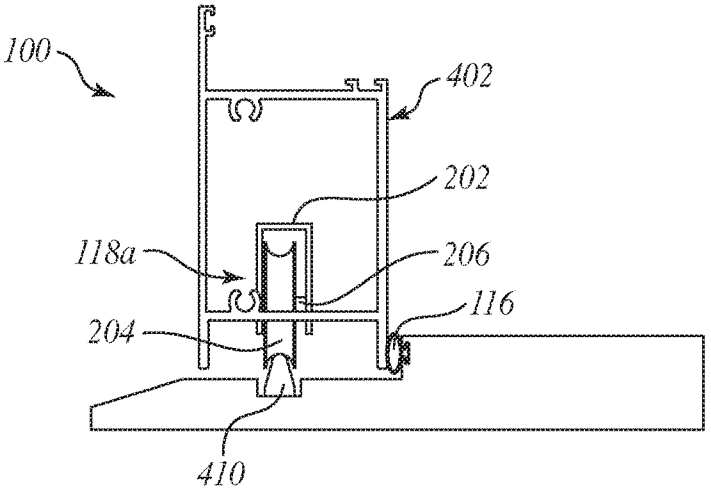
FIGS. 8A and 8B are schematic end views of another embodiment of the assembly of FIGS. 6A-6B.
Figure 8A:
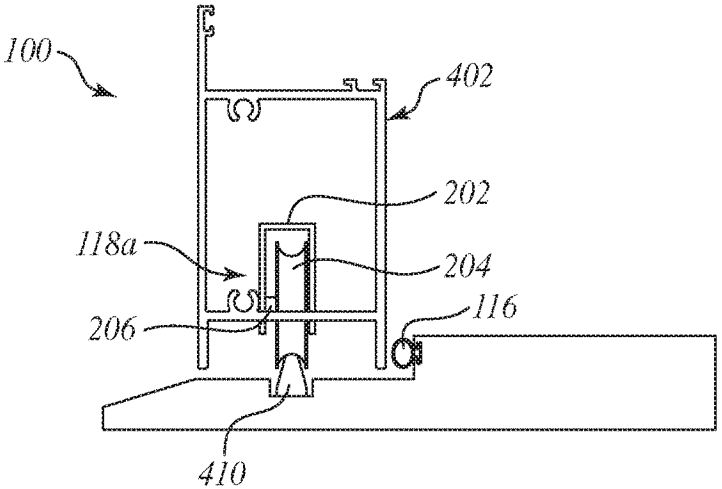

FIGS. 8A and 8B are schematic end views of another alternative embodiment of the assembly 100 of FIGS. 6A-6B. In the illustrated embodiment, the lower sliding assemblies 118*a,b* (only the first lower sliding assembly 118*a* visible) are operatively coupled to the lower panel member 402 at the carriage 202. The carriage 202 may be oversized (e.g., wider) to allow the wheel 204 room to shift laterally within the carriage 202 on the axle 206.

In FIG. 8A, the lower panel member 402 (e.g., the door panel 102 of FIGS. 1A-1B) is in the sliding (open) position and, therefore, is laterally offset from the gasket 116. Consequently, the lower panel member 402 (e.g., the door panel 102) is free to move horizontally by sliding on the first lower sliding assembly 118*a*, which rides on the rail 410.

In FIG. 8B, the lower panel member 402 (e.g., the door panel 102 of FIGS. 1A-1B) has been moved (shifted) to the sealing (closed) position and, therefore, has come into compressed and sealing engagement with the gasket 116. The first lower sliding assembly 118*a*, however, does not correspondingly shift laterally with the lower panel member 402 (e.g., the door panel 102) since the wheels 204 are received within the rail 410. Rather, as the lower panel member 402 (e.g., the door panel 102) shifts laterally into the sealing position, the wheel 204 remains stationary and slides along the axle 206. Consequently, the wheel 204 is able to remain relatively vertical in orientation during this process.

Figure 9A:
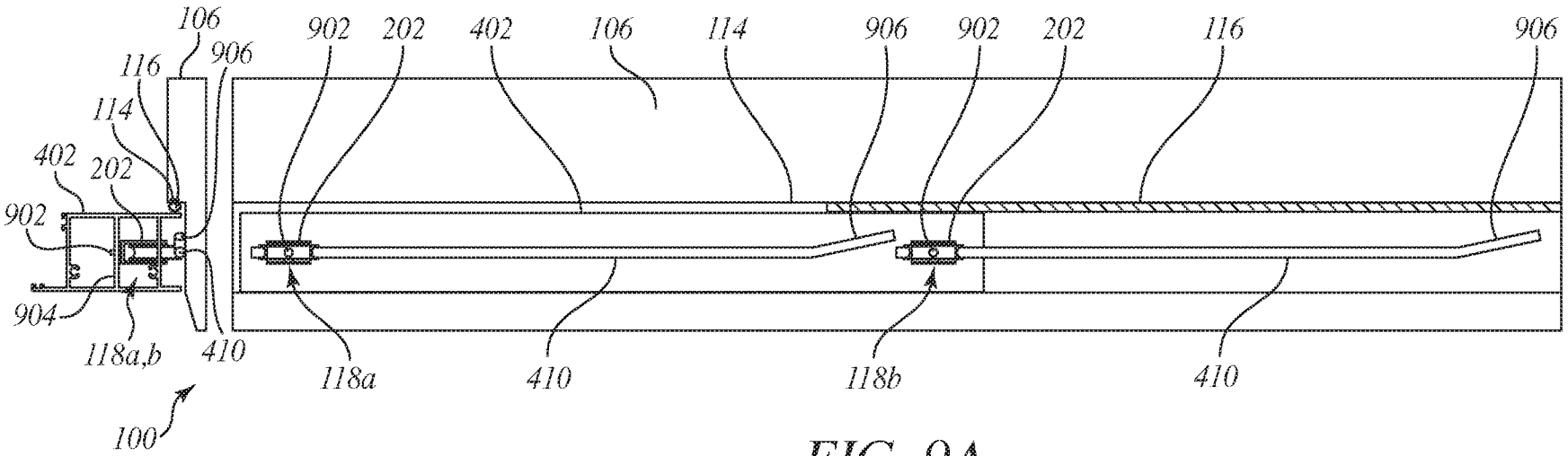
FIGS. 9A and 9B are combined end and top views of yet another embodiment of the assembly of FIGS. 1A-1B.
Figure 9B:
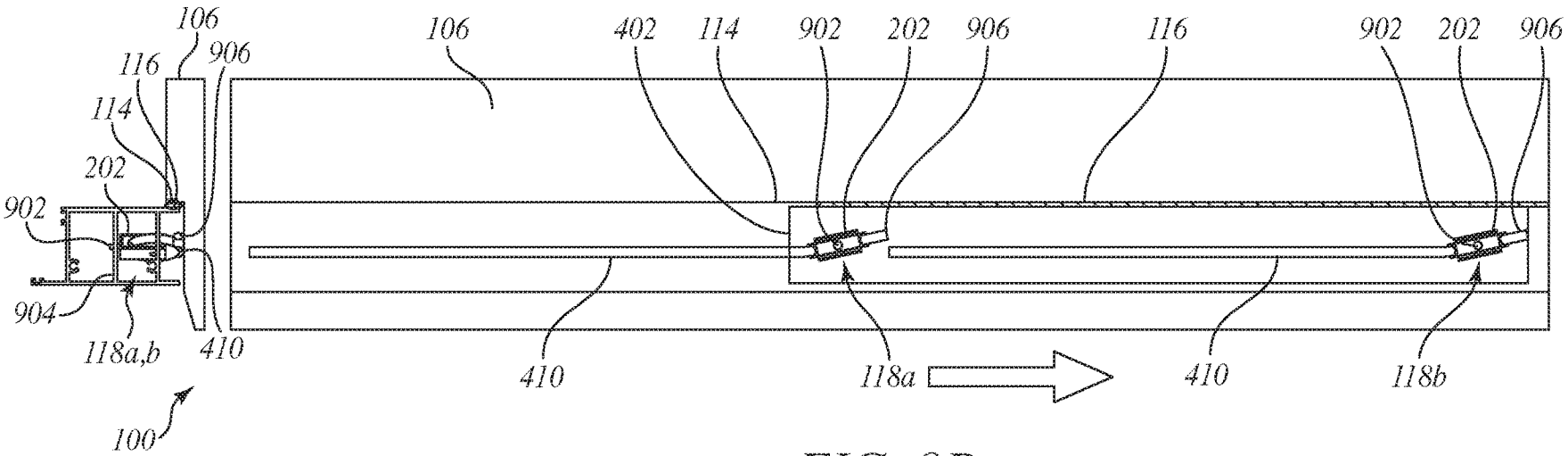

FIGS. 9A and 9B are combined end and top views of yet another embodiment of the assembly 100, according to one or more additional embodiments. More specifically, FIGS. 9A and 9B depict a portion of the assembly 100 in the sliding (open) and sealed (closed) positions, respectively. In the illustrated embodiment, the lower sliding assemblies 118*a,b* are operatively coupled to and otherwise carried by the lower panel member 402. As with prior embodiments, the lower panel member 402 is arranged adjacent the bottom member 106 and configured to move horizontally relative to bottom member 106 when in the sliding position.

In at least one embodiment, the lower sliding assemblies 118*a,b* may be rotatably mounted to the lower panel member 402 to enable the lower sliding assemblies 118*a,b* to rotate (swivel) upon moving to the sealed position. As illustrated, the lower sliding assemblies 118*a,b* may each include a pivot pin 902 extending from the respective carriage 202, and the pivot pin 902 may be received by the lower panel member 402 at a cross bar 904. Accordingly, the lower sliding assemblies 118*a,b* may be rotatably (pivotably) coupled to the cross bar 904 in the same manner as a caster or a caster wheel.

To help transition the lower panel member 402 (e.g., the door panel 102 of FIGS. 1A-1B) between the sliding and sealed positions, the rail 410 that the lower sliding assemblies 118*a,b* traverse (roll on) may provide at least one bent section 906 (two shown). As they traverse the bent sections 906 in the horizontal direction, the lower sliding assemblies 118*a,b* will be directed toward the raised lip 114, which correspondingly brings the lower panel member 402 (e.g., the door panel 102) into sealing engagement with the gasket 116.

In FIG. 9A, the lower panel member 402 (e.g., the door panel 102 of FIGS. 1A-1B) is in the sliding (open) position and, therefore, is positioned laterally offset from the gasket 116. Consequently, the lower panel member 402 (e.g., the door panel 102) is free to move horizontally by sliding on the lower sliding assemblies 118*a,b*.

In FIG. 9B, the lower panel member 402 (e.g., the door panel 102 of FIGS. 1A-1B) has been moved horizontally to the sealing (closed) position and, therefore, has come into compressed and sealing engagement with the gasket 116. In some embodiments, the lower panel member 402 (e.g., the door panel 102) may be manually moved horizontally to the sealing position, such as by a user manually grasping a handle (e.g., the handle 124 of FIGS. 1A-1B) and pulling/pushing the lower panel member 402 (e.g., the door panel 102) toward the sealing position. In other embodiments, however, movement of the lower panel member 402 (e.g., the door panel 102) may be automated and otherwise powered by a motor and suitable gearing, without departing from the scope of the disclosure.

As the lower panel member 402 (e.g., the door panel 102 of FIGS. 1A-1B) moves to the sealing (closed) position, the lower sliding assemblies 118*a,b* will eventually encounter and traverse the bent section(s) 906 of the rails 410. The bent section(s) 906 are angled to redirect the lower sliding assemblies 118*a,b* laterally toward the raised lip 114, which correspondingly draws the lower panel member 402 (e.g., the door panel 102) into sealing engagement with the gasket 116.

While FIGS. 9A and 9B describe operation of the lower sliding assemblies 118*a,b* in conjunction with the lower panel member 402, it will be appreciated that the foregoing discussion is equally applicable to the upper sliding assemblies 120*a,b* (FIGS. 1A-1B and 3A-3B) in conjunction with a corresponding upper panel member, without departing from the scope of the disclosure.

Figure 10A:
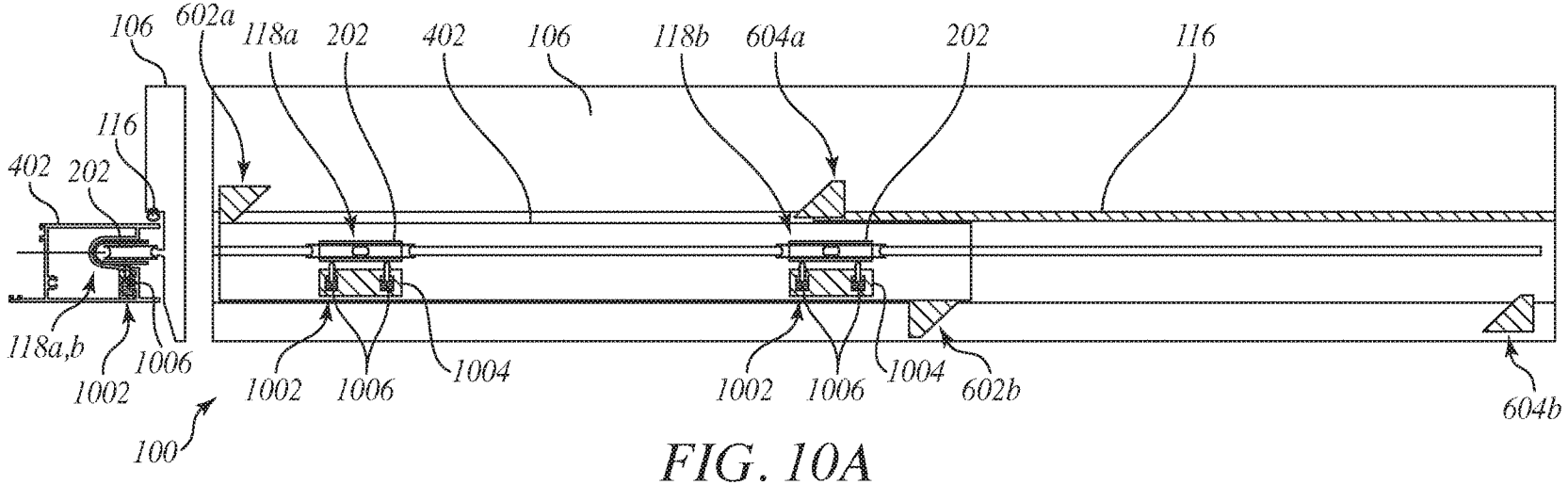
FIGS. 10A and 10B are combined end and top views of yet another embodiment of the assembly of FIGS. 1A-1B.
Figure 10B:
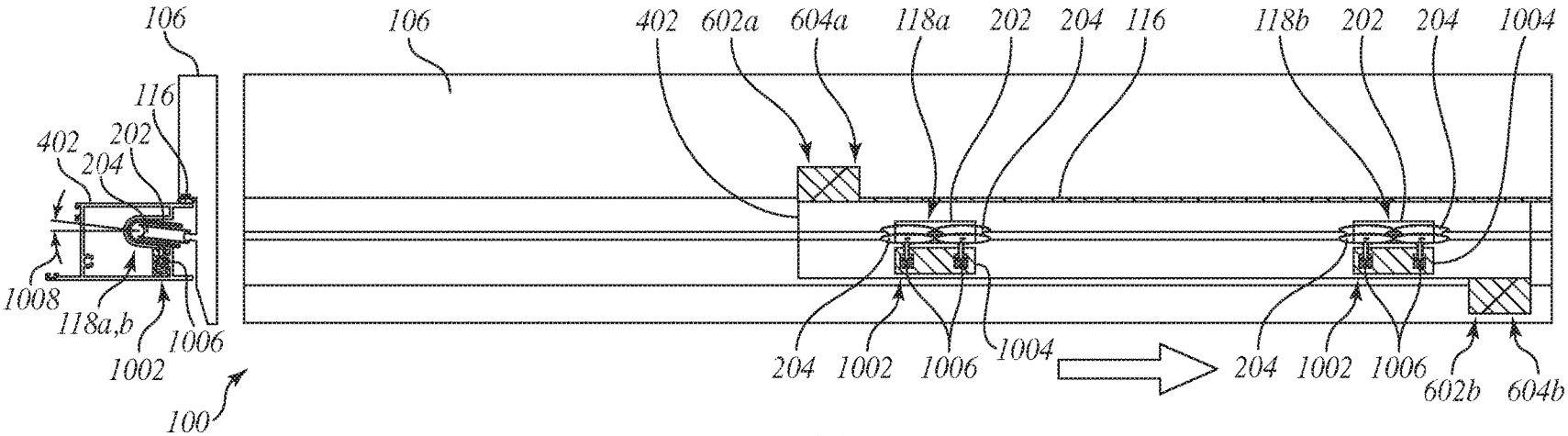

FIGS. 10A and 10B are schematic top views of another embodiment of the assembly 100, according to one or more additional embodiments. More specifically, FIGS. 10A and 10B depict a portion of the assembly 100 in the sliding (open) and sealed (closed) positions, respectively. In the illustrated embodiment, the lower sliding assemblies 118*a,b* are operatively coupled to and otherwise carried by the lower panel member 402, which is coupled to or forms part of the door panel 102 (FIGS. 1A-1B). As with prior embodiments, the lower panel member 402 is arranged adjacent the bottom member 106 and configured to move horizontally relative to bottom member 106 when in the sliding position.

FIGS. 10A and 10B also show the lower sliding assemblies 118*a,b* in the tilted and vertical configurations, respectively. As illustrated, each lower sliding assembly 118*a,b* may further include or otherwise incorporate a biasing assembly 1002 configured to provide a constant biasing force on the lower sliding assemblies 118*a,b*. In some embodiments, each biasing assembly 1002 may include a cartridge 1004 coupled to the lower panel member 402. One or more biasing devices 1006 may be coupled to the cartridge 1004 and extend to a corresponding lower sliding assembly 118*a,b*. The biasing devices 1006 may be configured to provide a constant contraction (retraction) biasing force on the carriage 202 to urge the corresponding lower sliding assembly 118*a,b* toward the vertical configuration. In some embodiments, for example, the biasing devices 1006 may comprise tension coil springs or the like.

The assembly 100 may further include the sets of opposing wedges described above with reference to FIGS. 6A-6B. More particularly, the assembly 100 may include the first and second dynamic wedges 602*a,b* coupled to or forming part of the lower panel member 402 (e.g., the door panel 102 of FIGS. 1A-1B), and the first and second stationary wedges 604*a,b* coupled to or forming part of the bottom member 106.

In FIG. 10A, the lower panel member 402 (e.g., the door panel 102 of FIGS. 1A-1B) is in the sliding (open) position and, therefore, is positioned laterally offset from the gasket 116. Consequently, the lower panel member 402 (e.g., the door panel 102) is free to move horizontally by sliding on the lower sliding assemblies 118*a,b*. Moreover, in FIG. 10A, the lower sliding assemblies 118*a,b* and are in the vertical configuration and the biasing assemblies 1002 are acting on the lower sliding assemblies 118*a,b* to help maintain the lower sliding assemblies 118*a,b* in the vertical configuration.

In FIG. 10B, the lower panel member 402 (e.g., the door panel 102 of FIGS. 1A-1B) has been moved horizontally to the sealing (closed) position and, therefore, has come into compressed and sealing engagement with the gasket 116. As with embodiments provided above, the lower panel member 402 (e.g., the door panel 102) may be manually moved or moved through an automated system, without departing from the scope of the disclosure.

As the lower panel member 402 (e.g., the door panel 102 of FIGS. 1A-1B) moves to the sealing (closed) position, the dynamic and stationary wedges 602*a,b*, 604*a,b* will eventually come into contact with each other and urge the lower panel member 402 (e.g., the door panel 102) laterally toward the gasket 116 and eventually into compressed engagement therewith. As the lower panel member 402 (e.g., the door panel 102) moves laterally to the sealing position, the lower sliding assemblies 118*a,b* correspondingly transition to the tilted configuration, where the wheels 204 are tilted at an angle 1004 offset from perpendicular to the bottom member 106 and otherwise at an angle 1008 between vertical and horizontal.

As the lower sliding assemblies 118*a,b* transition to the tilted configuration, the biasing devices 1006 may be extended and build up spring force. When the lower panel member 402 (e.g., the door panel 102) is moved back to the sliding (open) position, the spring force built up in the biasing devices 1006 will cause the lower sliding assemblies 118*a,b* to move back to the vertical configuration.

While FIGS. 10A and 10B describe operation of the lower sliding assemblies 118*a,b* in conjunction with the lower panel member 402, it will be appreciated that the foregoing discussion is equally applicable to the upper sliding assemblies 120*a,b* (FIGS. 1A-1B and 3A-3B) in conjunction with a corresponding upper panel member, without departing from the scope of the disclosure.

Embodiments Disclosed Herein Include:

A. A sliding door assembly that includes a door panel, a frame that supports the door panel and includes a bottom member with a lower profile and a top member with an upper profile, wherein the lower and upper tracks are parallel to one another, a lower sliding assembly operatively coupled to a bottom of the door panel and engaging the lower profile, an upper sliding assembly operatively coupled to a top of the door panel and engaging the upper profile, and a gasket interposing the door panel and a portion of the frame when the door panel is in a sealed position, wherein the door panel is movable between the sealed position, where the gasket creates a sealed interface between the door panel and the frame, and a sliding position, where the door panel is moved laterally away from the frame while remaining substantially perpendicular to a floor.

B. A method that includes providing a sliding door assembly that includes a door panel, a frame that supports the door panel and includes a bottom member with a lower profile and a top member with an upper profile parallel to the lower profile, a lower sliding assembly operatively coupled to a bottom of the door panel and engaging the lower profile, and an upper sliding assembly operatively coupled to a top of the door panel and engaging the upper profile. The method may further include placing the door panel in a sealed position, where a gasket interposing the door panel and a portion of the frame creates a sealed interface between the door panel and the frame, and moving the door panel to a sliding position by moving the door panel laterally away from the frame while the door panel remains substantially perpendicular to a floor.

Each of embodiments A and B may have one or more of the following additional elements in any combination: Element 1: wherein at least one of the lower and upper profiles is a track. Element 2: further comprising a raised lip provided on the frame, wherein the gasket is positioned on at least a portion of the raised lip. Element 3: wherein at least one of the lower and upper profiles includes a rail that is angled towards the raised lip. Element 4: further comprising a handle that is manually articulable to transition the door panel between the sealed position and the sliding position. Element 5: wherein at least one of the lower and upper sliding assemblies comprises a carriage and one or more wheels rotatably mounted to the carriage, and wherein the one or more wheels are engageable with the profile that engages the at least one of the lower and upper sliding assemblies. Element 6: wherein the at least one of the lower and upper sliding assemblies is movable between a tilted configuration, where the one or more wheels of the tiltable lower and/or upper sliding assemblies are tilted at an angle offset from perpendicular, and a vertical configuration, where the one or more wheels of the tiltable lower and/or upper sliding assemblies are substantially perpendicular to horizontal. Element 7: further comprising a handle that is manually articulable to transition the tiltable lower and/or upper sliding assemblies between the tilted and vertical configurations, wherein, when the tiltable lower and/or upper sliding assemblies are in the tilted configuration, the door panel is in the sealed position, and wherein, when the tiltable lower and/or upper sliding assemblies are in the vertical configuration, the door panel is in the sliding position. Element 8: further comprising a first vertical strut extending from the handle, a horizontal bracket pivotably coupled to the first vertical strut and engageable with one of the lower and upper sliding assemblies. Element 9: further comprising a dynamic wedge coupled to the door panel, and a stationary wedge coupled to the frame, wherein the door panel is movable to the sealed position by slidably engaging opposing angled surfaces of the dynamic and stationary wedges and thereby urging the door panel laterally toward the frame and the gasket. Element 10: wherein at least one of the lower and upper sliding assemblies is coupled to the door panel at a shifting axle that allows the at least one of the lower and upper sliding assemblies to shift laterally along the shifting axle(s) as the door panel is transitioned between the sliding and sealed positions. Element 11: wherein at least one of the lower and upper sliding assemblies comprises a carriage and one or more wheels rotatably mounted to the carriage at an axle, and wherein the one or more wheels shift laterally within the carriage as the door panel is transitioned between the sliding and sealed positions. Element 12: wherein at least one of the lower and upper sliding assemblies is movable between a tilted configuration, where the one or more wheels are tilted at an angle offset from perpendicular, and a vertical configuration, where the one or more wheels are substantially perpendicular to horizontal, the sliding door assembly further comprising a biasing assembly operatively coupled to at least one of the lower and upper sliding assemblies and providing a constant biasing force that urges the at least one of the lower and upper sliding assemblies toward the vertical configuration. Element 13: wherein at least one of the lower and upper sliding assemblies comprises a carriage pivotably coupled to the door panel and one or more wheels rotatably mounted to the carriage, wherein at least one of the lower and upper profiles includes a rail engageable with the one or more wheels, and the rail provides a bent section angled to laterally shift the door panel to the sealing position as the one or more wheels traverse the bent section. Element 14: wherein moving the door panel to the sliding position comprises manually articulating a handle that is operatively coupled to at least one of the lower and upper sliding assemblies. Element 15: wherein at least one of the lower and upper sliding assemblies comprises a carriage and one or more wheels rotatably mounted to the carriage, and wherein the one or more wheels are engageable with the profile that engages the at least one of the lower and upper sliding assemblies, and wherein moving the door panel to the sliding position further comprises moving the lower and/or upper sliding assemblies comprising the carriage between a tilted configuration, where the one or more wheels are tilted at an angle offset from perpendicular, and a vertical configuration, where the one or more wheels are substantially perpendicular to horizontal. Element 16: further providing a constant biasing force that urges the tiltable lower and/or upper sliding assemblies toward the vertical configuration. Element 17: wherein the sliding door assembly further includes a dynamic wedge coupled to the door panel and a stationary wedge coupled to the frame, and wherein placing the door panel in the sealed position comprises slidably engaging opposing angled surfaces of the dynamic and stationary wedges and thereby urging the door panel laterally toward the frame and the gasket. Element 18: wherein at least one of the lower and upper sliding assemblies comprises a carriage pivotably coupled to the door panel and one or more wheels rotatably mounted to the carriage, wherein profile that engages the at least one of the lower and upper sliding assemblies includes a rail engageable with the one or more wheels, and wherein placing the door panel in the sealed position comprises traversing a bent section of the rail with the one or more wheels, the bent section being angled to laterally shift the door panel to the sealing position. Element 19: wherein at least one of the lower profile and the upper profile includes a rail upon which sliding assembly that engages the at least one of the lower profile and upper profile rides and the rail is angled toward the gasket, the method further comprising urging lateral movement of the door panel to the sealed position with the rail.

By way of non-limiting example, exemplary combinations applicable to A and B include: Element 2 with Element 3; Element 5 with Element 6; Element 6 with Element 7; Element 7 with Element 8; Element 9 with Element 10; Element 9 with Element 11; Element 9 with Element 12; and Element 15 with Element 16. In addition by way of non-limiting example combinations applicable to A and B include: Elements 1 through 13 and any combination of Elements 1 through 13; and Elements 14-19 and any combination of Elements 14-19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Although various example embodiments have been disclosed, a worker of ordinary skill in this art would recognize that certain modifications would come within the scope of this disclosure. For that reason, the following claims should be studied to determine the scope and content of this disclosure.

What is claimed is:

1. A sliding door assembly, comprising:

a door panel;

a frame that supports the door panel and includes a bottom member with a lower profile and a top member with an upper profile, wherein the lower profile and the upper profile are parallel to one another;

a lower sliding assembly operatively coupled to a bottom of the door panel and engaging the lower profile;

an upper sliding assembly operatively coupled to a top of the door panel and engaging the upper profile;

a gasket interposing the door panel and a raised lip provided on the frame; and a rail provided by the lower profile and upon which the lower sliding assembly traverses, wherein the door panel is movable between a sealed position, where the gasket creates a sealed interface between the door panel and the frame, and a sliding position, where the door panel is moved laterally relative to the frame while remaining substantially perpendicular to a floor, and wherein the rail is angled towards the raised lip to urge the door panel laterally to the sealed position.

2. The sliding door assembly of claim 1 wherein at least one of the lower and upper profiles is a track.

3. The sliding door assembly of claim 1, wherein the gasket is positioned on at least a portion of the raised lip.

4. The sliding door assembly of claim 1, further comprising a handle that is manually articulable to transition the door panel between the sealed position and the sliding position.

5. The sliding door assembly of claim 1, wherein at least one of the lower and upper sliding assemblies comprises a carriage and one or more wheels rotatably mounted to the carriage, and wherein the one or more wheels are engageable with the profile that engages the at least one of the lower and upper sliding assemblies.

6. The sliding door assembly of claim 5, wherein the at least one of the lower and upper sliding assemblies is movable between a tilted configuration, where the one or more wheels are tilted at an angle offset from perpendicular to the bottom or top member, and a vertical configuration, where the one or more wheels are substantially perpendicular to the bottom or top member.

7. The sliding door assembly of claim 6, further comprising a handle that is manually articulable to transition the at least one of the lower and upper sliding assemblies between the tilted and vertical configurations, wherein, when the at least one of the lower and upper sliding assemblies is in the tilted configuration, the door panel is in the sealed position, and wherein, when the at least one of the lower and upper sliding assemblies is in the vertical configuration, the door panel is in the sliding position.

8. The sliding door assembly of claim 7, further comprising:

a first vertical strut extending from the handle;

a horizontal bracket pivotably coupled to the first vertical strut and engageable with one of the lower and upper sliding assemblies.

9. A method, comprising:

providing a sliding door assembly that includes:

a door panel;

a frame that supports the door panel and includes a bottom member with a lower profile and a top member with an upper profile parallel to the lower profile;

a lower sliding assembly operatively coupled to a bottom of the door panel and engaging the lower profile;

an upper sliding assembly operatively coupled to a top of the door panel and engaging the upper profile; and a rail provided by the lower profile and upon which the lower sliding assembly rides;

placing the door panel in a sealed position, where a gasket interposing the door panel and a portion of the frame creates a sealed interface between the door panel and the frame;

moving the door panel to a sliding position by moving the door panel laterally relative to the frame while the door panel remains substantially perpendicular to a floor; and urging the door panel laterally to the sealed position with the rail, the rail being angled towards the portion of the frame.

10. The method of claim 9, wherein moving the door panel to the sliding position comprises manually articulating a handle that is operatively coupled to at least one of the lower and upper sliding assemblies.

11. The method of claim 9, wherein at least one of the lower and upper sliding assemblies comprises a carriage and one or more wheels rotatably mounted to the carriage, and wherein the one or more wheels are engageable with the profile that engages the at least one of the lower and upper sliding assemblies, and wherein moving the door panel to the sliding position further comprises:

moving the at least one of the lower and upper sliding assemblies comprising the carriage between a tilted configuration, where the one or more wheels are tilted at an angle offset from perpendicular to the bottom or top member, and a vertical configuration, where the one or more wheels are substantially perpendicular to the bottom or top member.

12. The sliding door assembly of claim 1, wherein at least one of the lower and upper sliding assemblies comprises a carriage and one or more wheels rotatably mounted to the carriage, the sliding door assembly further comprising:

a handle;

a vertical strut extending from the handle;

a horizontal bracket pivotably coupled to the vertical strut; and one or more pins extending from the carriage and received within a corresponding one or more angled slots defined in the horizontal bracket, wherein the handle is manually articulable to move the vertical strut and the horizontal bracket and thereby slide the one or more pins within the one or more angled slots, whereby the at least one of the lower and upper sliding assemblies is movable between a tilted configuration, where the one or more wheels are tilted at an angle offset from perpendicular to the bottom or top member, and a vertical configuration, where the one or more wheels are substantially perpendicular to the bottom or top member.

13. The method of claim 9, wherein at least one of the lower and upper sliding assemblies comprises a carriage having one or more pins extending therefrom and one or more wheels rotatably mounted to the carriage, and wherein moving the door panel to the sliding position comprises:

manually articulating a handle and thereby moving a vertical strut extending from the handle and a horizontal bracket pivotably coupled to the vertical strut; and sliding the one or more pins within a corresponding one or more angled slots defined in the horizontal bracket as the horizontal bracket moves and thereby moving the at least one of the lower and upper sliding assemblies between a tilted configuration, where the one or more wheels are tilted at an angle offset from perpendicular to the bottom or top member, and a vertical configuration, where the one or more wheels are substantially perpendicular to the bottom or top member.

* * * * *